US009013517B2

(12) United States Patent
Toshima et al.

(10) Patent No.: US 9,013,517 B2
(45) Date of Patent: Apr. 21, 2015

(54) LIQUID CRYSTAL DISPLAY DEVICE

(75) Inventors: Goki Toshima, Chiba (JP); Yoshihisa Ooishi, Kanagawa (JP); Ryutaro Oke, Chiba (JP); Junichi Maruyama, Chiba (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 371 days.

(21) Appl. No.: 13/415,351

(22) Filed: Mar. 8, 2012

(65) Prior Publication Data

US 2012/0229524 A1 Sep. 13, 2012

(30) Foreign Application Priority Data

Mar. 10, 2011 (JP) ..... 2011-052651

(51) Int. Cl.

| | |
|---|---|
| ***G09G 5/10*** | (2006.01) |
| ***G09G 3/36*** | (2006.01) |
| *G09G 3/20* | (2006.01) |

(52) U.S. Cl.

CPC ..... *G09G 3/3688* (2013.01); *G09G 3/2025* (2013.01); *G09G 3/3648* (2013.01); *G09G 2320/0223* (2013.01); *G09G 2320/0276* (2013.01); *G09G 2340/0435* (2013.01)

(58) Field of Classification Search

CPC ..... G09G 2300/0823; G09G 3/3614; G09G 3/3607

USPC ..... 345/690, 89

See application file for complete search history.

(56) References Cited

U.S. PATENT DOCUMENTS

| | | | | |
|---|---|---|---|---|
| 2004/0196243 | A1 | 10/2004 | Masutani et al. | |
| 2006/0152462 | A1 | 7/2006 | Furihata et al. | |
| 2006/0158413 | A1 | 7/2006 | Morita | |
| 2006/0238460 | A1 * | 10/2006 | Huang | 345/76 |
| 2008/0012840 | A1 | 1/2008 | Higashino et al. | |
| 2008/0204439 | A1 * | 8/2008 | Morita | 345/209 |
| 2009/0040244 | A1 * | 2/2009 | Lee et al. | 345/690 |
| 2009/0102766 | A1 | 4/2009 | Oke et al. | |
| 2010/0045708 | A1 | 2/2010 | Higashino | |
| 2011/0205260 | A1 * | 8/2011 | Weng et al. | 345/691 |
| 2011/0221760 | A1 | 9/2011 | Irie et al. | |

FOREIGN PATENT DOCUMENTS

| | | |
|---|---|---|
| JP | 2008-209890 | 9/2008 |
| WO | 2010/073775 | 7/2010 |

* cited by examiner

*Primary Examiner* — Srilakshmi K Kumar
*Assistant Examiner* — Carl Adams
(74) *Attorney, Agent, or Firm* — Hamre, Schumann, Mueller & Larson, P.C.

(57) ABSTRACT

Provided is a liquid crystal display device, including: a data line; a plurality of pixel circuits; an output grayscale value generating circuit for outputting an output grayscale value obtained by correcting a display grayscale value indicating a grayscale potential having one of positive polarity and negative polarity; and a data-line driving circuit for selectively outputting an output potential having one of positive polarity and negative polarity corresponding to the output grayscale value to the data line. The data-line driving circuit outputs the potential so that the positive-polarity output potential corresponding to a smallest output grayscale value becomes lower than a positive-polarity grayscale potential indicated by a smallest one of the display grayscale values and that the negative-polarity output potential corresponding to the smallest output grayscale value becomes higher than a negative-polarity grayscale potential indicated by the smallest one of the display grayscale values.

15 Claims, 14 Drawing Sheets

FIG.8

| Din | DD | Dout2 |
|---|---|---|
| | 255 | 255 |
| | ·<br>·<br>· | ·<br>·<br>· |
| 255 | 245 (B) | 245 |
| 254 | 244.5 | OUTPUT 245 AND 244 IN TIME DIVISION |
| 253 | 244 | 244 |
| 252 | 243.5 | OUTPUT 244 AND 243 IN TIME DIVISION |
| ·<br>·<br>· | ·<br>·<br>· | ·<br>·<br>· |
| 217 | 226 | 226 |
| 216 | 225.5 | OUTPUT 225 AND 226 IN TIME DIVISION |
| 215 | 225 (D) | 225 |
| 214 | 224 | 224 |
| 213 | 223 | 223 |
| ·<br>·<br>· | ·<br>·<br>· | ·<br>·<br>· |
| 1 | 11 | 11 |
| 0 | 10 (C) | 10 |
| | ·<br>·<br>· | ·<br>·<br>· |
| | 0 | 0 |

LIQUID CRYSTAL DISPLAY DEVICE

CROSS-REFERENCE TO RELATED APPLICATION

The present application claims priority from Japanese application JP 2011-052651 filed on Mar. 10, 2011, the content of which is hereby incorporated by reference into this application.

BACKGROUND OF THE INVENTION

1. Field of the Invention

The present invention relates to a liquid crystal display device, in particular, a data-line driving circuit included in a liquid crystal display device.

2. Description of the Related Art

A liquid crystal display device includes a plurality of pixel circuits. A data-line driving circuit included in the liquid crystal display device feeds a potential for allowing each of the pixel circuits to display a grayscale through a data line. It takes a certain period of time for the potential actually fed to each pixel circuit to reach a potential output by the data-line driving circuit to the data line. The reasons for the time include a parasitic capacitance generated between the data line and another wiring, a delay due to a wiring resistance, and insufficient driving capability of transistors. Therefore, a difference is generated between the potential of the pixel circuit reaching within a horizontal period and the potential applied to the data line. For preventing deterioration of image quality due to the difference in potential, a potential obtained by correcting the potential indicating a display grayscale is fed to the data line so as to reduce a difference between the potential actually fed to the pixel circuit and the potential indicating the display grayscale in an existing technology.

Japanese Patent Application Laid-open No. 2008-209890 discloses a display device in which a potential obtained by correcting a potential indicating a display grayscale is fed to a data line.

In the case where the signal to be fed to the data line is corrected for changing the potential of the pixel circuit within a shorter period of time, the potential of the corrected signal is a potential emphasizing a difference between the potential to be fed to the pixel circuit in a preceding stage and the potential to be fed to the pixel circuit in the current stage with respect to pixel circuits which connects the same data line. When a conventional data-line driving circuit is used, however, the signal cannot be satisfactorily corrected in some cases. For example, the data-line driving circuit cannot feed a potential lower than a potential for the lowest-level grayscale. Therefore, when the display grayscale changes from the highest-level grayscale to the lowest-level grayscale, the potential cannot be corrected to be lowered any more. Thus, the difference between the potential that the pixel circuit should reach and the potential that the pixel circuit actually reaches within the horizontal period becomes larger. As a result, image quality is sometimes deteriorated.

SUMMARY OF THE INVENTION

The present invention has been made to solve the problem described above, and has an object to provide a liquid crystal display device capable of reducing a difference between a potential that a pixel circuit should reach and a potential that the pixel circuit actually reaches, so as to reduce the deterioration of image quality.

Representative aspects of the present invention disclosed in this application are briefly described as follows.

(1) A liquid crystal display device, including: a data line; a plurality of pixel circuits, each including a transistor switch and a pixel electrode connected to the data line via the transistor switch; an output grayscale value generating circuit for outputting an output grayscale value corresponding to one of a plurality of candidate values, the output grayscale value being obtained by correcting a display grayscale value indicating a grayscale potential having one of positive polarity and negative polarity to be applied to one end of the transistor switch included in any one of the plurality of pixel circuits; and a data-line driving circuit for selectively outputting, to the data line, an output potential having one of the positive polarity and the negative polarity corresponding to the output grayscale value from among a plurality of positive-polarity and negative-polarity output potentials corresponding to the plurality of candidate values, respectively, in which the data-line driving circuit outputs the potential having one of the positive polarity and the negative polarity so that a lowest one of the plurality of positive-polarity output potentials respectively corresponding to the plurality of candidate values becomes lower than a lowest positive-polarity grayscale potential indicated by the display grayscale value and that a highest one of the plurality of negative-polarity output potentials respectively corresponding to the plurality of candidate values becomes higher than a highest negative-polarity grayscale potential indicated by the display grayscale value.

(2) The liquid crystal display device according to the above-mentioned item (1), in which the data-line driving circuit outputs the potential having one of the positive polarity and the negative polarity so that the lowest one of the plurality of positive-polarity output potentials respectively corresponding to the plurality of candidate values becomes lower than the highest one of the plurality of negative-polarity output potentials respectively corresponding to the plurality of candidate values.

(3) The liquid crystal display device according to the above-mentioned item (1) or (2), in which the data-line driving circuit outputs the potential having one of the positive polarity and the negative polarity so that a highest one of the plurality of positive-polarity output potentials respectively corresponding to the plurality of candidate values becomes higher than a highest positive-polarity grayscale potential indicated by the display grayscale value and that a lowest one of the plurality of negative-polarity output potentials respectively corresponding to the plurality of candidates becomes lower than a lowest negative-polarity grayscale potential indicated by the display grayscale value.

(4) The liquid crystal display device according to any one of the above-mentioned items (1) to (3), in which: the plurality of pixel circuits are arranged in a plurality of rows; the output grayscale value generating circuit generates an output grayscale value of a precharge signal based on the display grayscale value for any one of the pixel circuits in a row and a display grayscale value for one of the pixel circuits in a preceding row, and generates an output grayscale value of an image signal based on the display grayscale value for the any one of the plurality of pixel circuits in the row; and the data-line driving circuit sequentially outputs an output potential corresponding to the output grayscale value of the precharge signal and an output potential corresponding to the output grayscale value of the image signal.

(5) The liquid crystal display device according to the above-mentioned item (4), in which: the lowest positive-polarity grayscale potential indicated by the display grayscale value is a positive-polarity output potential of the image signal which is output by the data-line driving circuit in accordance with the display grayscale value indicating the lowest positive-polarity grayscale potential; and the highest negative-polarity grayscale potential indicated by the display grayscale value is a negative-polarity output potential of the image signal which is output by the data-line driving circuit in accordance with the display grayscale value indicating the highest negative-polarity grayscale potential.

(6) The liquid crystal display device according to any one of the above-mentioned items (1) to (5), in which a number of display grayscale values indicating the potential within a range of the grayscale potential having one of the positive polarity and the negative polarity, corresponding to a range of brightness from a maximum brightness displayed by the plurality of pixel circuits to a half of the maximum brightness, is larger than a number of the candidate values corresponding to the output potential within the range.

(7) The liquid crystal display device according to the above-mentioned item (6), in which the data-line driving circuit outputs an output grayscale value periodically changing in accordance with at least a part of the display grayscale values indicating the potential within the range of the grayscale potential.

(8) The liquid crystal display device according to any one of the above-mentioned items (1) to (7), in which: the data-line driving circuit includes: a positive-polarity potential output section for outputting a positive-polarity output potential; and a negative-polarity potential output section for outputting a negative-polarity output potential; the positive-polarity potential output section outputs the positive-polarity output potential corresponding to the output grayscale value based on a plurality of first reference potentials; the negative-polarity potential output section outputs the negative-polarity output potential corresponding to the output grayscale value based on a plurality of second reference potentials; two of the plurality of first reference potentials are the lowest positive-polarity grayscale potential indicated by the display grayscale value and a potential lower than the lowest positive-polarity grayscale potential; and two of the plurality of second reference potentials are the highest negative-polarity grayscale potential indicated by the display grayscale value and a potential higher than the highest negative-polarity grayscale potential.

(9) The liquid crystal display device according to the above-mentioned item (4), in which the output grayscale value generating circuit outputs the output grayscale value of the image signal so that the output grayscale value corresponding to the display grayscale value increases monotonously as the display grayscale value increases; and the output grayscale value generating circuit outputs an output grayscale value corresponding to the display grayscale value with one-to-one correspondence for the display grayscale value equal to or smaller than a predetermined display grayscale value indicating a brightness higher than a half of a maximum brightness, and outputs an output grayscale value corresponding to any one of the other display grayscale values for at least a part of the display grayscale values exceeding the predetermined display grayscale value.

(10) The liquid crystal display device according to the above-mentioned item (9), in which the output grayscale value generating circuit outputs the output grayscale value of the image signal, which periodically changes in accordance with at least a part of the display grayscale values larger than the predetermined display grayscale value.

(11) The liquid crystal display device according to the above-mentioned item (9) or (10), in which the data-line driving circuit has a larger rate of change in the output potential with respect to an increase in the output grayscale value within the range of the output grayscale value corresponding to the range of the display grayscale value from the predetermined display grayscale value to a largest display grayscale value, than a rate of change in the grayscale potential with respect to an increase in the display grayscale value within a range larger than the predetermined display grayscale value.

According to the present invention, it is possible to reduce the difference between the potential that the pixel circuit should reach and the potential that the pixel circuit actually reaches within a horizontal period, so as to reduce the deterioration of image quality, as compared with the case of not using the configuration of the present invention.

BRIEF DESCRIPTION OF THE DRAWINGS

In the accompanying drawings:

FIG. 8 is a table showing the relation among the display grayscale data, the gamma-converted data, and output grayscale data;

DETAILED DESCRIPTION OF THE INVENTION

Figure 1:
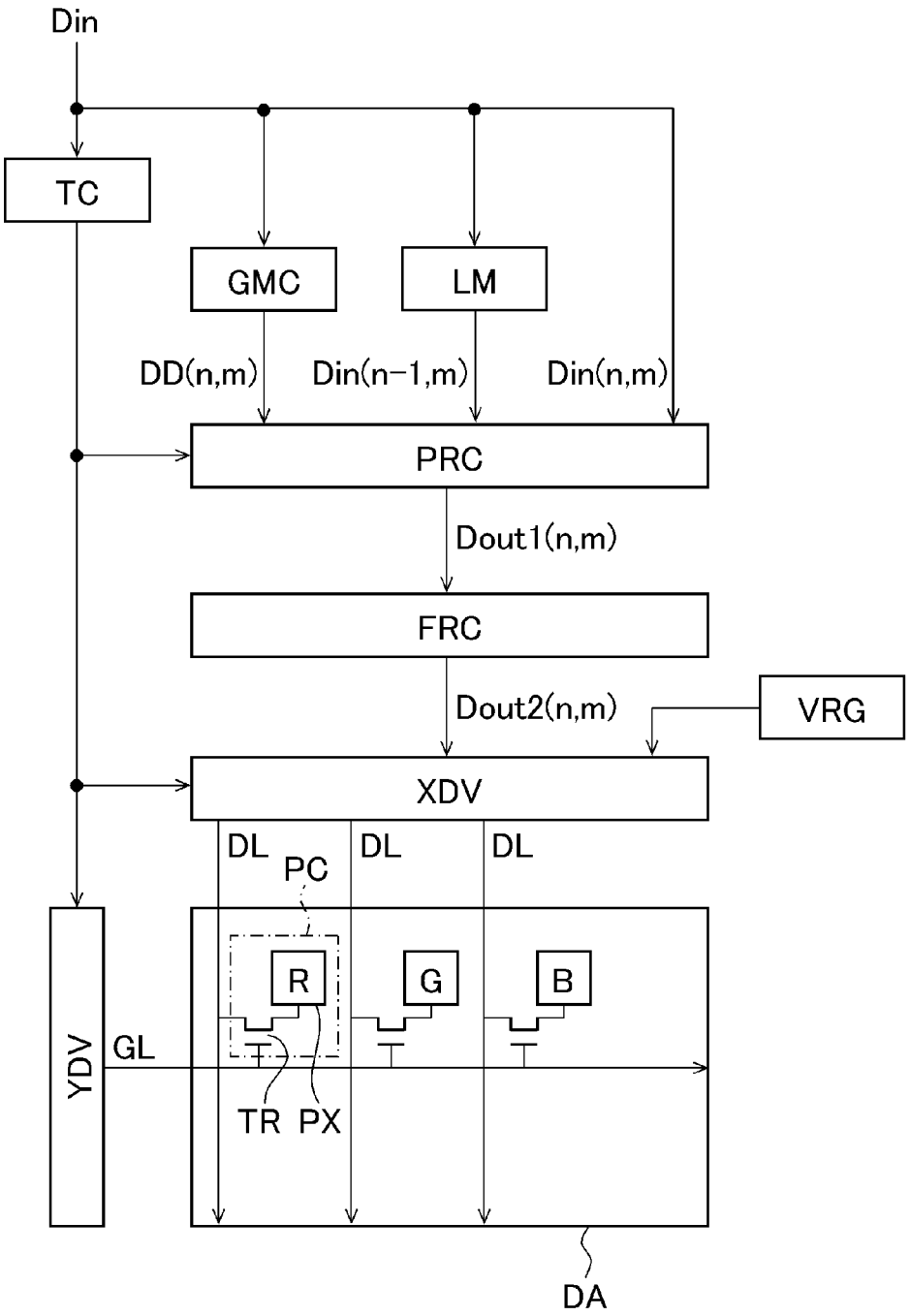
FIG. 1 is a diagram illustrating a configuration of a liquid crystal display device according to a first embodiment of the present invention.

Hereinafter, embodiments of the present invention are described based on the accompanying drawings. The components having the same functions, which are described and illustrated in this specification, are denoted by the same reference character, and the description thereof is herein omitted.

First Embodiment

A liquid crystal display device according to a first embodiment of the present invention includes a liquid crystal display panel, a backlight unit for supplying light transmitting through the liquid crystal display panel, and a control board. In terms of a structure, the liquid crystal display panel includes an array substrate, a counter substrate, liquid crystal, and an integrated-circuit package. On the array substrate, pixel circuits PC are formed. The counter substrate is provided so as to be opposed to the array substrate. The liquid crystal is sealed between the array substrate and the counter substrate. The integrated-circuit package is provided on the array substrate. Polarizer plates are bonded onto the outer side of the array substrate and the outer side of the counter substrate. The liquid crystal display device according to the first embodiment performs color display and uses normally-black liquid crystal.

FIG. 1 is a diagram illustrating an example of a configuration of the liquid crystal display device according to the first embodiment of the present invention. The liquid crystal display device according to the first embodiment includes a display region DA having a rectangular shape, a timing control circuit TC, a gamma conversion circuit GMC, a line memory LM, a precharge circuit PRC, a frame-rate control circuit FRC, a reference-potential providing circuit VRG, a data-line driving circuit XDV, a scanning-line driving circuit YDV, a plurality of scanning lines GL, a plurality of data lines DL, and common lines (not shown). The display region DA, the plurality of scanning lines GL, and the plurality of data lines DL are provided on the array substrate included in the liquid crystal display panel. In the display region DA, the plurality of pixel circuits PC are arranged in matrix. A part of the scanning-line driving circuit YDV and a part of the data-line driving circuit XDV are arranged on the array substrate around the display region DA. The remaining parts of the scanning-line driving circuit YDV and the data-line driving circuit XDV are provided in the integrated-circuit package. The timing control circuit TC, the gamma conversion circuit GMC, the line memory LM, the precharge circuit PRC, the reference-potential providing circuit VRG, and the frame-rate control circuit FRC are provided on the control board.

The scanning lines GL are aligned in the display region DA so as to extend in a horizontal direction in FIG. 1. A left end of each of the scanning lines GL is connected to the scanning-line driving circuit YDV. The data lines DL are arranged side by side in the display region DA so as to extend in a vertical direction in FIG. 1. An upper end of each of the data lines DL is connected to the data-line driving circuit XDV. Each of the pixel circuits PC is provided so as to correspond to a point of intersection of the data line DL and the scanning line GL. For color display, one pixel consists of three pixel circuits PC for displaying red, blue, and green, respectively. The three pixel circuits PC are arranged in the horizontal direction. When a resolution of a screen is 1,920 columns by 1,080 rows, the number of the pixel circuits PC provided in the display region DA is (1,920×3) columns by 1,080 rows. The number of the data lines DL is (1,920×3), whereas the number of the scanning lines GL is 1,080. Each of the data lines DL corresponds to the column of the pixel circuits PC, whereas each of the scanning lines GL corresponds to the row of the pixel circuits PC. The pixel circuits PC constituting one column display the same color and are connected to one of the data lines DL.

Each of the pixel circuits PC includes a pixel transistor TR and a pixel electrode PX forming a pixel capacitance with a common electrode (not shown). The pixel transistor TR is an n-channel type thin-film transistor operating as a switch. A gate electrode of the pixel transistor TR is connected to the scanning line GL corresponding to the pixel circuit PC including the same pixel transistor TR. A source electrode of the pixel transistor TR is connected to the data line DL corresponding to the pixel circuit PC, whereas a drain electrode thereof is connected to the pixel electrode PX. The thin-film transistor has no polarity and therefore the distinction between the source electrode and the drain electrode is made based on the potential applied thereto, for the sake of convenience. Although the destinations of connection of the source electrode and the drain electrode are described above for the sake of convenience, the destinations of connection may be interchanged with each other. The common electrode is electrically connected to the common line which provides a common potential.

In the liquid crystal display device, when the potential is applied to the data line DL, a predetermined period of time is required for a potential of the source electrode of the pixel transistor TR included in each of the pixel circuits PC to reach the applied potential. The causes of this are a parasitic capacitance generated between the data line DL and the scanning line GL, a delay due to a wiring resistance, insufficient driving capability of the pixel transistors TR, and the like. In order to reduce the above-mentioned period of time, the liquid crystal display device according to the embodiments of the present invention applies a potential Vp of a precharge signal in the first half of a horizontal period 1H and applies a potential Vd of an image signal in the second half of the horizontal period 1H. If a time average of the potential of the pixel electrode PX is offset from the common potential, the relation between a transmittance of the liquid crystal and a potential difference is out of order, sometimes resulting in a ghost image. For coping with the problem of generation of the ghost image, the data-line driving circuit XDV feeds the signals while switching between a positive-polarity signal for setting the potential of the pixel electrode PX higher than the common potential and a negative-polarity signal for setting the potential of the pixel electrode PX lower than the common potential every predetermined time.

Figure 2:
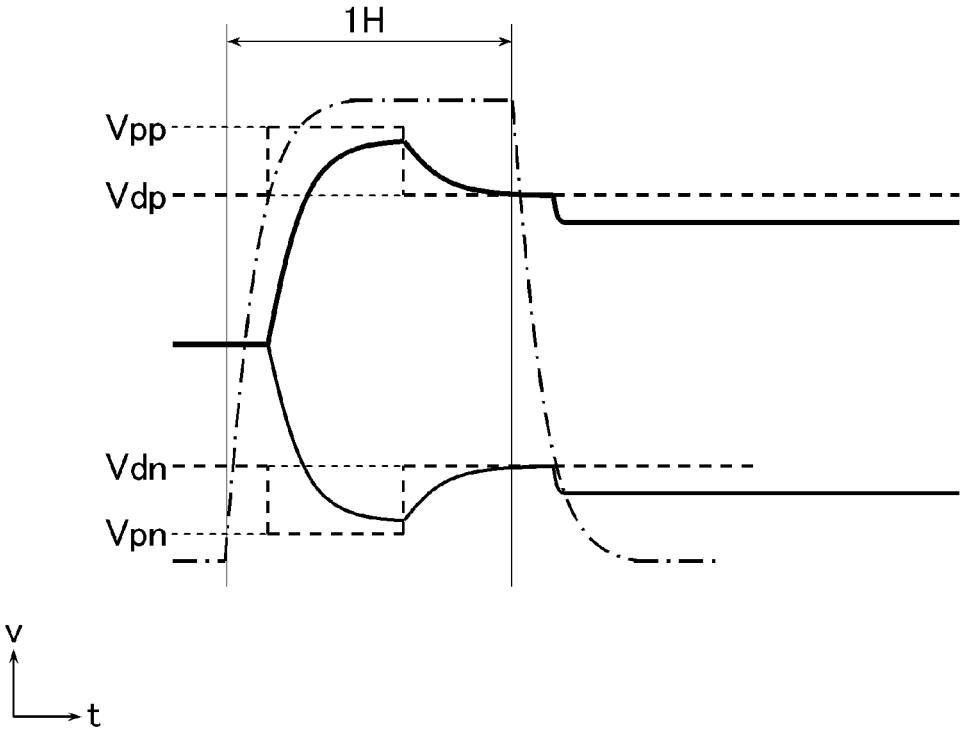
FIG. 2 is a waveform diagram illustrating an example of the relation between a potential of a precharge signal and a potential of an image signal.

FIG. 2 is a waveform diagram showing an example of the relation between the potential Vp of the precharge signal and the potential Vd of the image signal. A waveform indicated by a chained line represents a scanning signal applied to the scanning line GL. A period of time from a rise of the potential of the scanning signal to a fall thereof corresponds to the horizontal period 1H. Each of two broken lines represents a potential of a signal applied by the data-line driving circuit XDV to the data line DL, and each of two solid lines represents the potential of the pixel electrode PX. In the example shown in FIG. 2, the waveform indicated by the broken line indicating the potential increasing in the horizontal period 1H represents the potential of the positive-polarity signal applied to the data line DL and the waveform indicated by the solid line indicating the potential increasing in the horizontal period 1H represents the potential of the pixel electrode PX when the potential of the positive-polarity signal is applied. On the other hand, the waveform indicated by the broken line indicating the potential decreasing in the horizontal period 1H represents the potential of the negative-polarity signal applied to the data line DL and the waveform indicated by the solid line indicating the potential decreasing in the horizontal period 1H represents the potential of the pixel electrode PX when the potential of the negative-polarity signal is applied. The potential Vp of the precharge signal is a potential which is corrected so as to emphasize a difference between the potential Vd of the image signal applied to the data line DL for the pixel circuits PC of the previous row and the potential Vd of the image signal applied to the data line DL for the pixel circuits PC of the current row. When the potential Vd of the image signal changes from a potential indicating a low-level grayscale to a potential indicating a high-level grayscale, a potential Vpp of the positive-polarity precharge signal becomes higher than a potential Vdp of the positive-polarity image signal, and a potential Vpn of the negative-polarity precharge signal becomes lower than a potential Vdn of the negative-polarity image signal. The positive-polarity image signal is output subsequently to the positive-polarity precharge signal, and the negative-polarity image signal is subsequently output to the negative-polarity precharge signal. When the potential of the image signal changes from a potential indicating a high-level grayscale to a potential indicating a low-level grayscale, the potential Vpp of the positive-polarity precharge signal becomes lower than the potential Vdp of the positive-polarity image signal, and the potential Vpn of the negative-polarity precharge signal becomes higher than the potential Vdn of the negative-polarity image signal. The positive-polarity image signal is output subsequently to the positive-polarity precharge signal, and the negative-polarity image signal.

Display grayscale data Din fed from the exterior of the liquid crystal display device is input to the gamma conversion circuit GMC, the line memory LM, and the timing control circuit TC. In this embodiment, the display grayscale data Din consists of a display grayscale value corresponding to a value of a grayscale to be displayed by each of the pixel circuits PC. The display grayscale value is a value representing any one of 256 levels, ranging from 0 to 255. The display grayscale value indicates a positive-polarity or negative-polarity potential (hereinafter, referred to as "grayscale potential") that the potential of the source electrode of the pixel transistor TR is hoped to reach within the horizontal period 1H in which the pixel transistor TR included in the pixel circuit PC is turned ON. Hereinafter, the display grayscale value for the pixel circuit PC in the n-th column and the m-th row is described as a value of display grayscale data Din(n,m).

The gamma conversion circuit GMC, the line memory LM, the precharge circuit PRC, and the frame-rate control circuit FRC operate as an output grayscale value generating circuit for generating an output grayscale value to be input to the data-line driving circuit XDV. The schema of those circuits is described below. The output grayscale value indicates a potential (output potential) output from the data-line driving circuit XDV. The gamma conversion circuit GMC converts the display grayscale data Din to generate gamma-converted data DD. Gamma-converted data DD(n,m) corresponding to the pixel circuit PC in the n-th column and the m-th row contains the output grayscale value and adjustment information. The gamma conversion circuit GMC outputs the output grayscale value which allows the data-line driving circuit XDV to output the grayscale potential in accordance with the value of the display grayscale data Din(n,m) as the output grayscale value contained in the gamma-converted data DD(n,m) if there is the output grayscale value. Otherwise, the gamma conversion circuit GMC outputs the output grayscale value which allows the data-line driving circuit XDV to output a potential approximate to the grayscale potential. The adjustment information indicates a deviation between the grayscale potential and the output potential corresponding to the output grayscale value of the grayscale potential.

The line memory LM stores the display grayscale data Din for one row and outputs the stored data at timing at which the display grayscale data Din for a next row is input. In other words, the line memory LM outputs the display grayscale data Din(n−1,m) of the previous row. The precharge circuit PRC corrects the output grayscale value contained in the gamma-converted data DD(n,m) based on the value of the display grayscale data Din(n−1,m) of the previous row and the value of the display grayscale data Din(n,m) of the row as a target of output, so as to generate the output grayscale value indicating the potential of the precharge signal. The output grayscale value indicating the potential of the precharge signal and the gamma-converted data DD(n,m) are output collectively as internal grayscale data Dout1(*n,m*). When the display grayscale data Din(n−1,m) is smaller than the display grayscale data Din(n,m), the precharge circuit PRC outputs a value obtained by increasing the output grayscale value of the gamma-converted data DD(n,m) as the output grayscale value of the precharge signal. When the display grayscale data Din(n−1,m) is larger than the display grayscale data Din(n,m), the precharge circuit PRC outputs a value obtained by reducing the output grayscale value of the gamma-converted data DD(n,m) as the output grayscale value of the precharge signal.

The frame-rate control circuit FRC generates the output grayscale value indicating the potential of the precharge signal and the output grayscale value indicating the potential of the image signal based on the internal grayscale data Dout1(*n,m*) so as to output the output grayscale values as output grayscale data Dout2(*n,m*). Based on the output grayscale data Dout2(*n,m*), the data-line driving circuit XDV feeds the potential of the precharge signal to the data line DL connected to the pixel circuits PC in the m-th column in the first half of the horizontal period 1H in which the pixel circuits PC in the n-th row are scanned by the scanning-line driving circuit YDV and feeds the potential of the image signal to the data line DL in the second half of the horizontal period 1H.

The data-line driving circuit XDV outputs the output potential in accordance with the output grayscale value. In this embodiment, the output grayscale value which can be input to the data-line driving circuit XDV varies from 0 to 255. The positive-polarity or negative-polarity output potential in accordance with each output grayscale value is output. From another point of view, the data-line driving circuit XDV can output the output potential corresponding to each of predetermined 256 candidate values and selectively outputs the positive-polarity or negative-polarity output potential corresponding to the output grayscale value input to the data-line driving circuit among the positive-polarity and negative-polarity output potentials corresponding to the candidate values. In this embodiment, the normally-black liquid crystal is used.

Therefore, the positive-polarity output potential monotonously increases and the negative-polarity output potential monotonously decreases as the output grayscale value increases.

Figure 3:
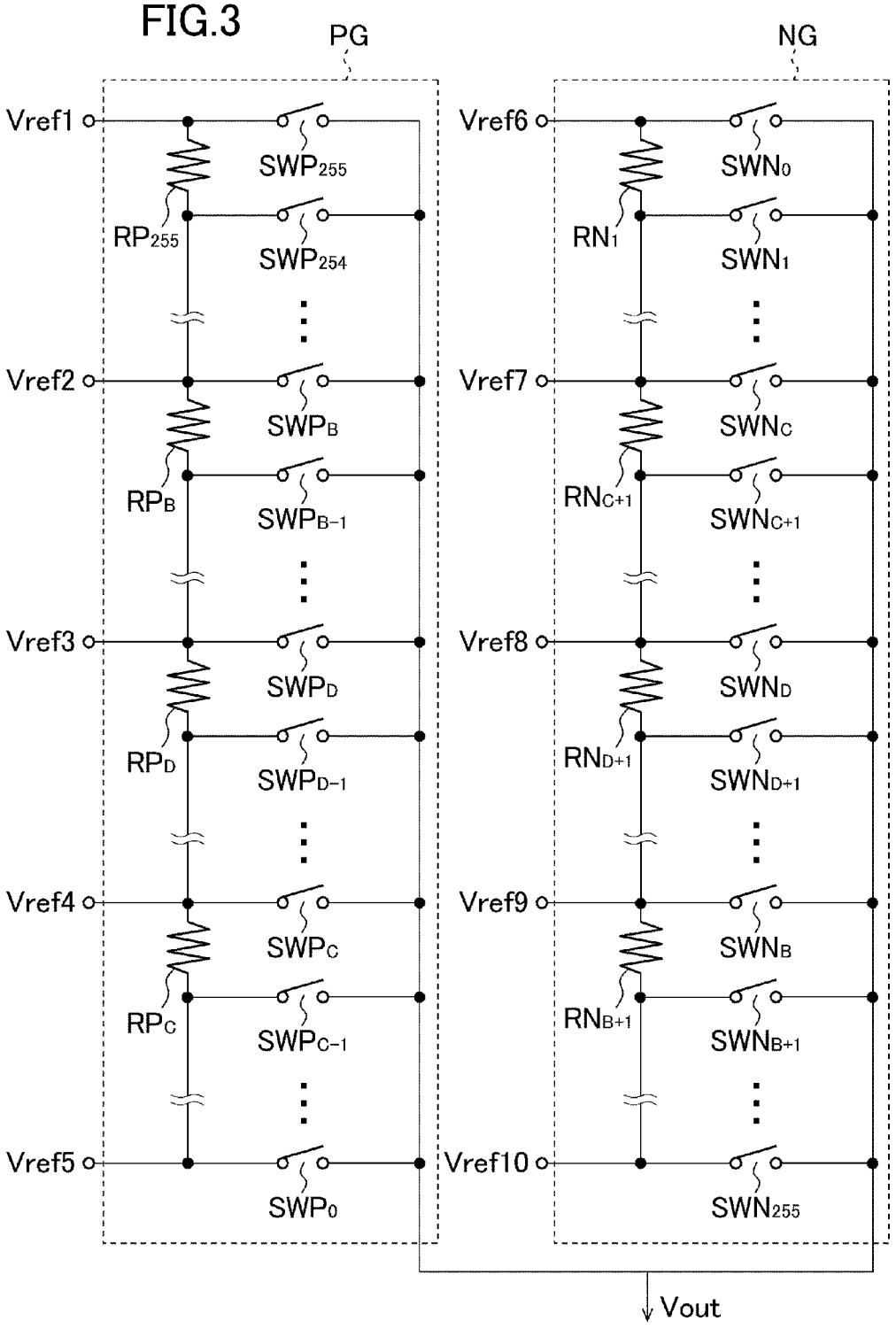
FIG. 3 is a diagram illustrating an example of a configuration of a data-line driving circuit.

FIG. 3 is a diagram illustrating an example of a configuration of the data-line driving circuit XDV. The data-line driving circuit XDV includes a positive-polarity output section PG for outputting a positive-polarity output potential and a negative-polarity output section NG for outputting a negative-polarity output potential. Which of the positive-polarity potential and the negative-polarity potential the data-line driving circuit XDV outputs is determined by a frame and the column of the pixel circuits PC to which the output potential is fed. In this embodiment, the polarity of the potential applied to one data line DL within one frame period is the same.

Assuming that the number of candidate values for the output grayscale value is q (255 in this embodiment), the positive-polarity potential output section PG includes q switches SWP and (q−1) resistors RP. The k-th (k is an integer from 1 to q) switch $SWP_{k-1}$ corresponds to the k-th smallest candidate value. The switches SWP are arranged in the order of the corresponding candidate values. Between one end of a switch $SWP_i$ (i is an integer from 1 to q−1) and one end of a switch $SWP_{i-1}$ adjacent thereto, the i-th resistor $RP_i$ is provided. Similarly, the negative-polarity output section NG includes q switches SWN and q−1 resistors RN. The k-th switch $SWN_{k-1}$ corresponds to the k-th smallest candidate value. The switches SWN are arranged in the order of the corresponding candidate values. Between one end of a switch $SWN_i$ and one end of a switch $SWN_{i-1}$ adjacent thereto, the i-th resistor $RN_i$ is provided. The other end of the k-th switch $SWP_{k-1}$ and the other end of the k-th switch $SWN_{k-1}$ are connected to the data line DL so as to output an output potential Vout to the data line DL.

The reference-potential providing circuit VRG provides reference potentials to ends of five switches SWP on the resistor RP side and ends of five switches SWN on the resistor RN side. The five switches are parts of the plurality of switches SWP and the five switches SWN are parts of the plurality of switches SWN. The reference potentials respectively provided to the switches SWP and SWN differ from each other. The output grayscale values (candidate values) corresponding to the switches SWP and SWN are 0 (the smallest value), C, D, B, and 255 (the largest value) in the increasing order. A reference-potential providing source VRG provides reference potentials Vref1, Vref2, Vref3, Vref4, and Vref5 to the switches $SWP_{255}$, $SWP_B$, $SWP_D$, $SWP_C$, and $SWP_0$ and reference potentials Vref6, Vref7, Vref8, Vref9, and Vref10 to the switches $SWN_0$, $SWN_C$, $SWN_D$, $SWN_B$, and $SWP_{255}$, respectively.

Figure 4:
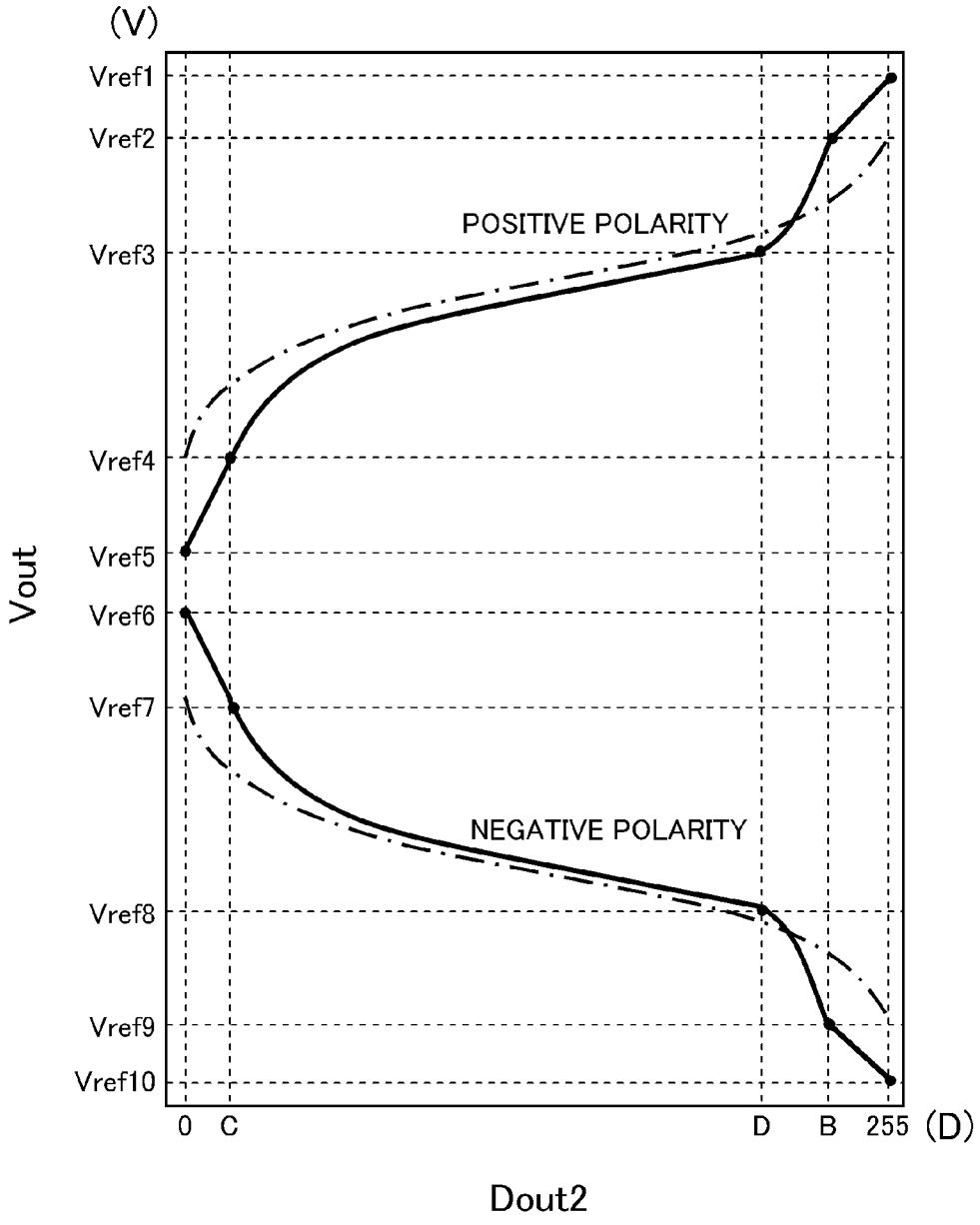
FIG. 4 is a graph showing an example of the relation between an output grayscale value and an output potential in the data-line driving circuit.

FIG. 4 is a graph showing an example of the relation between the output grayscale value and the output potential Vout of the data-line driving circuit XDV (DV curves). Chained lines shown in FIG. 4 indicate DV curves of the display grayscale value of the display grayscale data Din and the positive/negative-polarity grayscale potentials corresponding to the display grayscale value, whereas solid lines indicate DV curves of the output grayscale value and the output potential of the data-line driving circuit XDV. The reference potential Vref1 is the highest of the reference potentials Vref1 to Vref10. The potential becomes lower in the order from the reference potential Vref1 to the reference potential Vref10. The range of the positive-polarity potential in accordance with the display grayscale value is from Vref2 to Vref4, whereas the range of the negative-polarity potential in accordance with the display grayscale value is from Vref7 to Vref9. As can be seen from the DV curves, the relation between the output potential and the output grayscale is non-linear. In accordance with the non-linear relation, resistance values of the resistors RP and RN are not same.

The positive-polarity output potential in the case where the output grayscale value is C is the same as the positive-polarity grayscale potential in accordance with the smallest display grayscale value (the lowest positive-polarity grayscale potential indicated by the display grayscale value) and is the potential output from the switch $SWP_C$ having one end provided with the reference potential Vref4. The positive-polarity output potential in the case where the output grayscale value is B is the same as the positive-polarity grayscale potential in accordance with the largest display grayscale value (the highest positive-polarity grayscale potential indicated by the display grayscale value) and is the potential output from the switch $SWP_B$ having one end provided with the reference potential Vref2. The negative-polarity output potential in the case where the output grayscale value is C is the same as the negative-polarity grayscale potential in accordance with the smallest display grayscale value (the highest negative-polarity grayscale potential indicated by the display grayscale value) and is the potential output from the switch $SWN_C$ having one end provided with the reference potential Vref7. The negative-polarity output potential in the case where the output grayscale value is B is the same as the negative-polarity grayscale potential in accordance with the largest display grayscale value (the lowest negative-polarity grayscale potential indicated by the display grayscale value) and is the potential output from the switch $SWN_B$ having one end provided with the reference potential Vref9. The reference potential Vref1 is higher than the positive-polarity potential in accordance with the largest display grayscale value, whereas the reference potential Vref5 is lower than the positive-polarity potential in accordance with the smallest display grayscale value. The reference potential Vref6 is higher than the negative-polarity potential in accordance with the smallest display grayscale value, whereas the reference potential Vref10 is lower than the negative-polarity potential in accordance with the largest display grayscale value. By providing the reference potentials other than those corresponding to the range from the smallest output grayscale value to the largest output grayscale value, the degree of freedom for changing the range of the potential of the precharge signal becomes higher.

When the output grayscale value is 0 or larger and smaller than C, the positive-polarity output potential is lower than the positive-polarity potential in accordance with the smallest display grayscale value, whereas the negative-polarity output potential is higher than the negative-polarity potential in accordance with the smallest display grayscale value. The output grayscale values described above are used for outputting the potential of the precharge signal. When the output grayscale value is larger than B and 255 or smaller, the positive-polarity output potential is larger than the positive-polarity potential in accordance with the largest display grayscale value, whereas the negative-polarity output potential is lower than the negative-polarity potential in accordance with the largest display grayscale value. The output grayscale values described above are also used for outputting the potential of the precharge signal.

The positive-polarity and negative-polarity output potentials in the case where the output grayscale value is between C and D are the same as the positive-polarity and negative-polarity grayscale potentials in accordance with the display grayscale value which is smaller than the output grayscale value by C. On the other hand, the range of the positive-polarity and negative-polarity output potentials in the case where the output grayscale value is between D and B corresponds to the range of the grayscale potential having the display grayscale value varying from (D−C) to 255. Here, (B−D)<{255−(D−C)} is satisfied. Therefore, in this range, the output grayscale values do not have one-to-one correspondence. In the range of the display grayscale value from (D−C) to the largest value, the degree (absolute value) of a rate of change in the output potential with an increase in the output grayscale value corresponding to the display grayscale value becomes larger than the degree (absolute value) of a rate of change in the grayscale potential with an increase in the display grayscale value within the range. The output grayscale value D is any of the output grayscale values satisfying a condition that a brightness of display when the output potential in accordance with the output grayscale value is applied to the pixel circuits PC becomes larger than a half of the maximum brightness. The number of the display grayscale values within the range of the positive-polarity or negative-polarity grayscale potential, which corresponds to the range from the maximum brightness of the display by the pixel circuits PC to the brightness corresponding to the half of the maximum brightness, is larger than the number of candidate values corresponding to the output potential within the above-mentioned range.

The degree of change in the positive-polarity potential in accordance with the display grayscale value increases as the display grayscale value increases from the smallest value and then only decreases after the passage through a value (first value) in the vicinity of the center. On the other hand, there is a case where the degree of change in the positive-polarity output potential in accordance with the output grayscale value changes from increasing to decreasing or from decreasing to increasing at values other than the first value. In an example of FIG. 5, the degree of change increases at a second value (B) which is larger than the first value. Similarly, there is a case where the degree of change in the negative-polarity output potential in accordance with the output grayscale value changes from increasing to decreasing or from decreasing to increasing at values other than the first value. Such a case may arise depending on the way of change in the output potential at the level at which the output grayscale value exceeds B.

Figure 5:
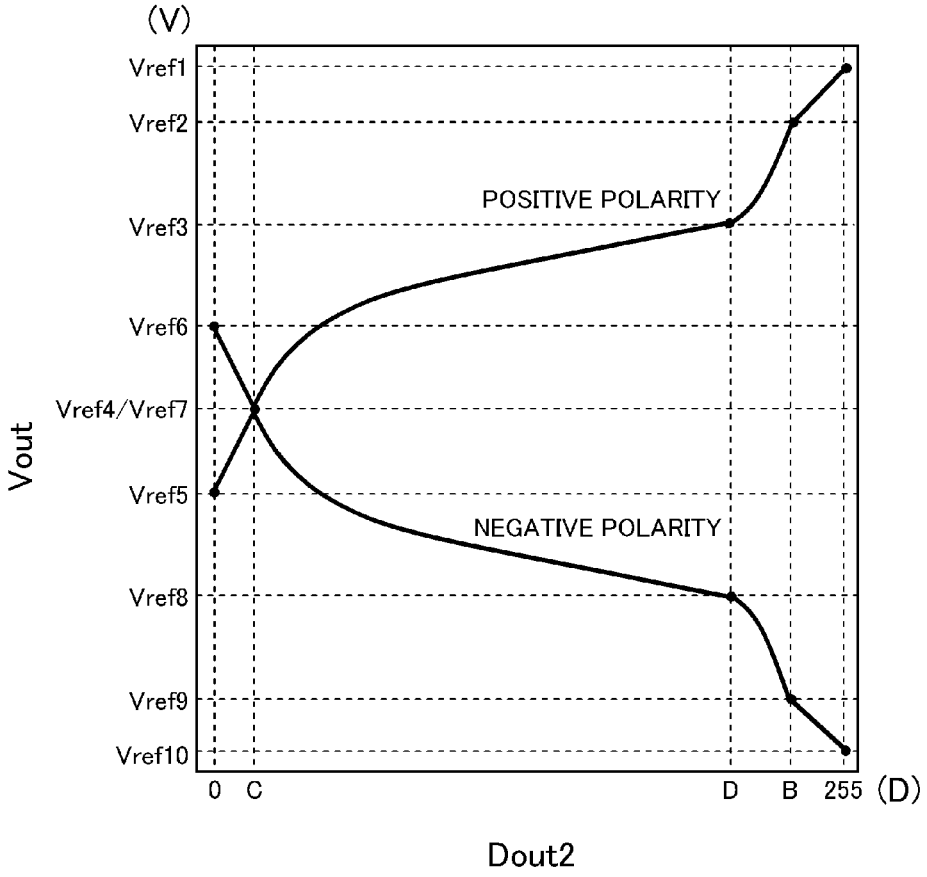
FIG. 5 is a graph showing another example of the relation between the output grayscale value and the output potential in the data-line driving circuit.

The positive-polarity potential and the negative-polarity potential in accordance with the smallest display grayscale value may be the same. FIG. 5 is a graph showing another example of the relation between the output grayscale value and the output potential Vout of the data-line driving circuit XDV. In this example, the reference potential Vref4 and the reference potential Vref7 are the same value. Moreover, the reference potential Vref6 is lower than the reference potential Vref5. Further, as shown in FIG. 5, the positive-polarity output potential corresponding to the smallest candidate value may be lower than the negative-polarity output potential corresponding to the smallest candidate value. In this manner, the signal can be more reliably corrected.

Figure 6:
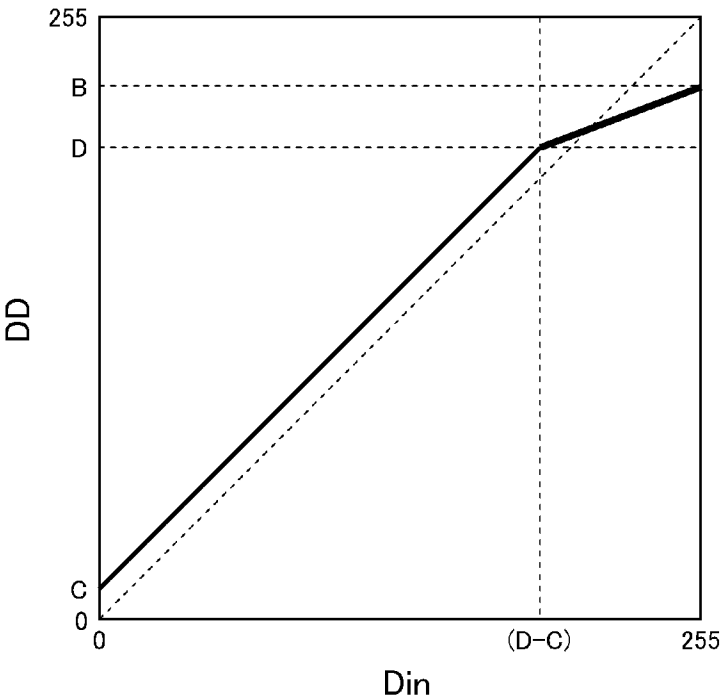
FIG. 6 is a graph showing an example of the relation between a value of display grayscale data input to a gamma conversion circuit and an output grayscale value of gamma-converted data.

FIG. 6 is a graph showing an example of the relation between the value of the display grayscale data Din(n,m), which is input to the gamma conversion circuit GMC, and the output grayscale value of the gamma-converted data DD(n,m). The gamma conversion circuit GMC outputs C, which is the output grayscale value larger than the smallest candidate value of the output grayscale value, as the gamma-converted data DD(n,m) when the smallest display grayscale value is input as the value of the display grayscale data Din(n,m), and outputs D, which is the output grayscale value smaller than the largest candidate value of the output grayscale value, as the gamma-converted data DD(n,m) when the largest display grayscale value is input. The correspondence between the display grayscale value, and the output grayscale value and the adjustment information contained in the gamma-converted data DD(n,m) is indicated with the DV curves of FIG. 4 (or FIG. 5). For the display grayscale value from 0 to (D−C) or 255, the display grayscale value and the output grayscale value correspond to each other in one-to-one correspondence. For the display grayscale value from (D−C+1) to 254, one display grayscale value corresponds to one output grayscale value or two display grayscale values correspond to one output grayscale value.

It is difficult for human eyes to perceive a difference in grayscale at high brightness. Therefore, even if the output of the potential in accordance with the display grayscale value on the high brightness side becomes incorrect, the incorrect output is less likely to be perceived than on the low brightness side. Therefore, the deterioration of image quality due to a lowered grayscale can be reduced. In this embodiment, the adjustment information consists of 1 bit. When the bit of the adjustment information represents 0, the grayscale potential indicated by the display grayscale value is equal to the output potential in accordance with the output grayscale value. On the other hand, when the bit of the adjustment information represents 1, the grayscale potential indicated by the display grayscale value is higher than the output potential in accordance with the output grayscale value and is lower than the output potential which is output in accordance with an output grayscale value which is larger than the output grayscale value by one.

Figure 7:
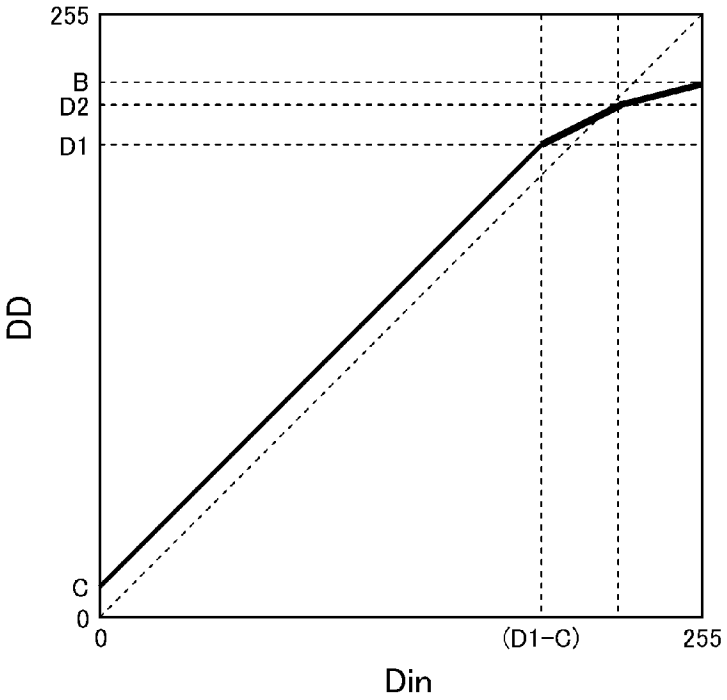
FIG. 7 is a graph showing another example of the relation between the value of the display grayscale data input to the gamma conversion circuit and the output grayscale value of the gamma-converted data.

FIG. 7 is a graph showing another example of the relation between the display grayscale value input to the gamma conversion circuit and the output grayscale value of the gamma-converted data. An output grayscale value D1 in the example shown in FIG. 7 corresponds to D in the example shown in FIG. 6. For the display grayscale value from 0 to (D1−C) or 255, the display grayscale value and the output grayscale value correspond to each other in one-to-one correspondence. For the display grayscale value from (D1−C+1) to 254, one display grayscale value corresponds to one output grayscale value or two display grayscale values correspond to one output grayscale value. In this case, N1 is larger than N2. N1 means the number of output grayscale values which corresponds to two display grayscale values and which is in the rage from D2 to B, and N2 means the number of output grayscale values which corresponds to two display grayscale values and which is in the range from D1 to D2. In this manner, for the same reason as described in the example of FIG. 6, the deterioration of image quality due to a reduction in grayscale can be reduced. This case requires the DV curves of the data-line driving circuit XDV in accordance with the example of FIG. 7.

The frame-rate control circuit FRC acquires the gamma-converted data DD(n,m) generated in the gamma conversion circuit GMC via the precharge circuit PRC. When the grayscale potential indicated by the display grayscale value and the output potential in accordance with the output grayscale value differ from each other, the frame-rate control circuit FRC periodically changes the output grayscale value of the output grayscale data Dout2(*n,m*) to control the pixel circuits PC to display a grayscale which cannot be expressed by the output grayscale value in a pseudo manner. The display grayscale values, for which the output grayscale values are periodically changed, are at least a part of values larger than (D−C) in the description for FIG. 6 and values larger than (D1−C) in the description for FIG. 7.

FIG. 8 is a table showing the relation among the display grayscale data Din(n,m), the gamma-converted data DD(n,m), and the output grayscale data Dout2(*n,m*). In the table of FIG. 8, a field for Din indicates the value (display grayscale value) of the display grayscale data Din(n,m), an integer portion of a numerical value in a field for DD indicates the output grayscale value contained in the gamma-converted data DD(n,m), a fractional portion of the numerical value in the field for DD indicates the adjustment information contained in the gamma-converted data DD(n,m), and a field for Dout2 indicates the output grayscale value to be output to the data-line driving circuit XDV. For example, "244.5" in the field for DD indicates that the output grayscale value is 244 and the bit of the adjustment information represents 1. In the example of FIG. 8, C is 10, D is 225, and B is 245. When the bit of the adjustment information represents 1, the frame-rate control circuit FRC outputs the output grayscale value of the gamma-converted data DD(n,m) and a value obtained by adding 1 to the gamma-converted data DD(n,m) as the output grayscale value of the output grayscale data Dout2(*n,m*) while switching between those values for each frame. The grayscale may be expressed in a pseudo manner by a method other than the one described above. For example, a finer grayscale may be expressed by using three or more frames, or the grayscale may be expressed by using output grayscale values which are not adjacent to each other.

Figure 9:
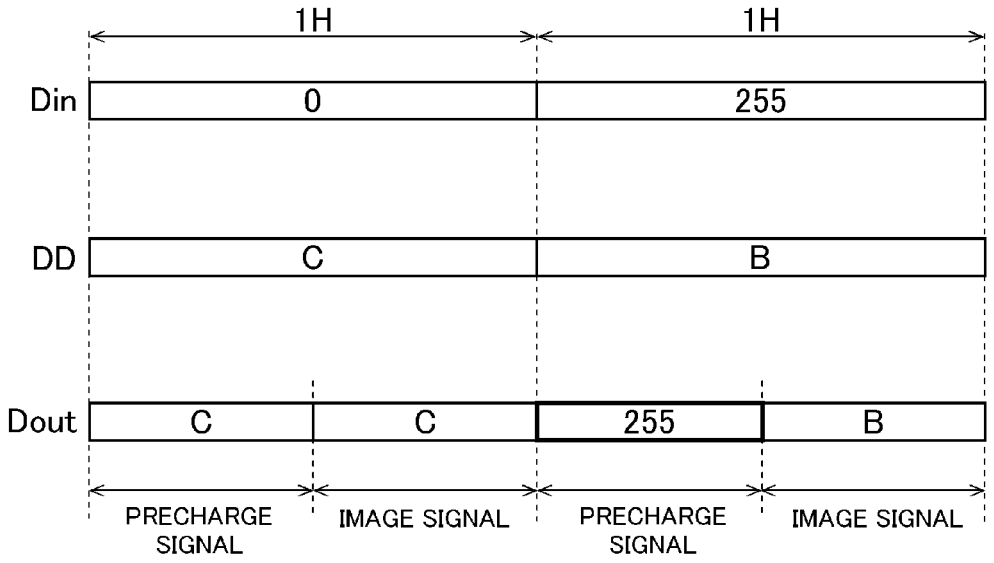
FIG. 9 is a chart showing changes with time of the display grayscale data, the gamma-converted data, and the output grayscale data in the case where the value of the display grayscale data changes from the smallest to the largest.

An example of an operation in the case where the value of the display grayscale data Din(n,m) changes from the smallest to the largest is described. FIG. 9 is a chart showing changes with time of the display grayscale data Din(n,m), the gamma-converted data DD(n,m), and the output grayscale data Dout2(*n,m*) in the above-mentioned case. In the first horizontal period 1H shown in FIG. 9, 0 is input as the value of the display grayscale data Din(n,m), and the output grayscale value of the gamma-converted data DD(n,m) generated thereby is C. When the display grayscale value of the display grayscale data Din(n,m) in a preceding horizontal period 1H is 0, the output grayscale value of the precharge signal contained in the output grayscale data Dout2(*n,m*) output from the frame-rate control circuit FRC is C, and the output grayscale value of the image signal is C. The frame-rate control circuit FRC outputs the output grayscale value of the precharge signal in the first half of one horizontal period and outputs the output grayscale value of the image signal in the second half.

In the second horizontal period 1H, 255 is input as the display grayscale value of the display grayscale data Din(n,m). The output grayscale value of the gamma-converted data DD(n,m) generated thereby is B. The output grayscale value of the precharge signal contained in the output grayscale data Dout2(*n,m*) output from the frame-rate control circuit FRC is the largest value, that is, 255, and the output grayscale value of the image signal is B.

Figure 10:
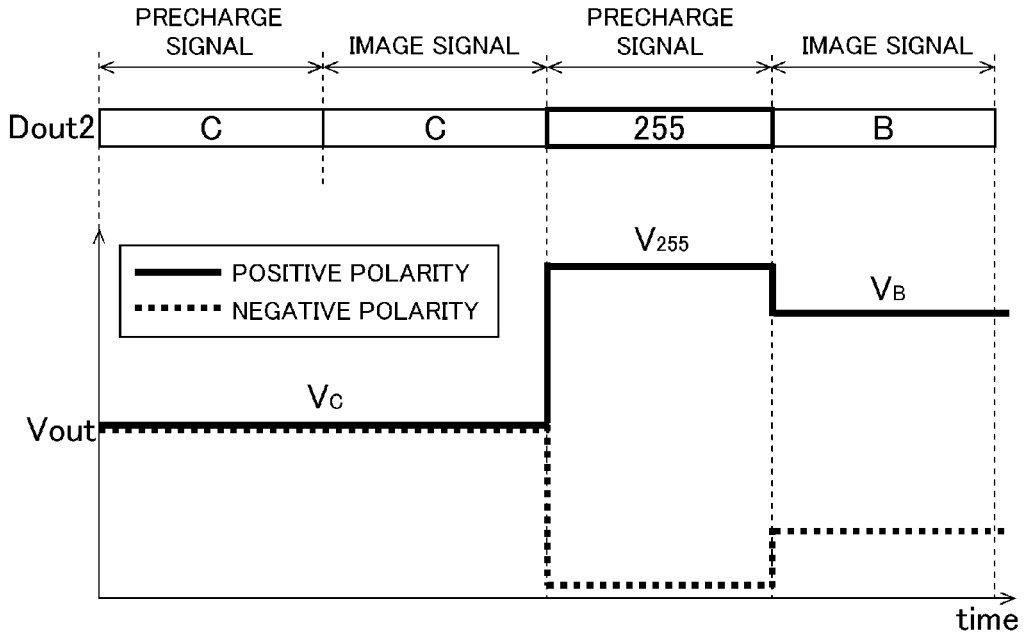
FIG. 10 is a chart showing changes with time of the output grayscale data and an output potential output from the data-line driving circuit in the case where the value of the display grayscale data changes from the smallest to the largest.

FIG. 10 is a chart showing changes with time of the output grayscale data Dout2(*n,m*) and the output potential Vout output from the data-line driving circuit XDV when the value of the display grayscale data Din(n,m) changes from the smallest to the largest. A solid-line waveform indicates the positive-polarity output potential Vout, whereas a broken-line waveform indicates the negative-polarity output potential Vout. Even when the display grayscale value becomes the largest, the data-line driving circuit XDV outputs the potential of the precharge signal larger than the potential of the corresponding positive-polarity image signal or the potential of the precharge signal smaller than the potential of the corresponding negative-polarity image signal.

Figure 11:
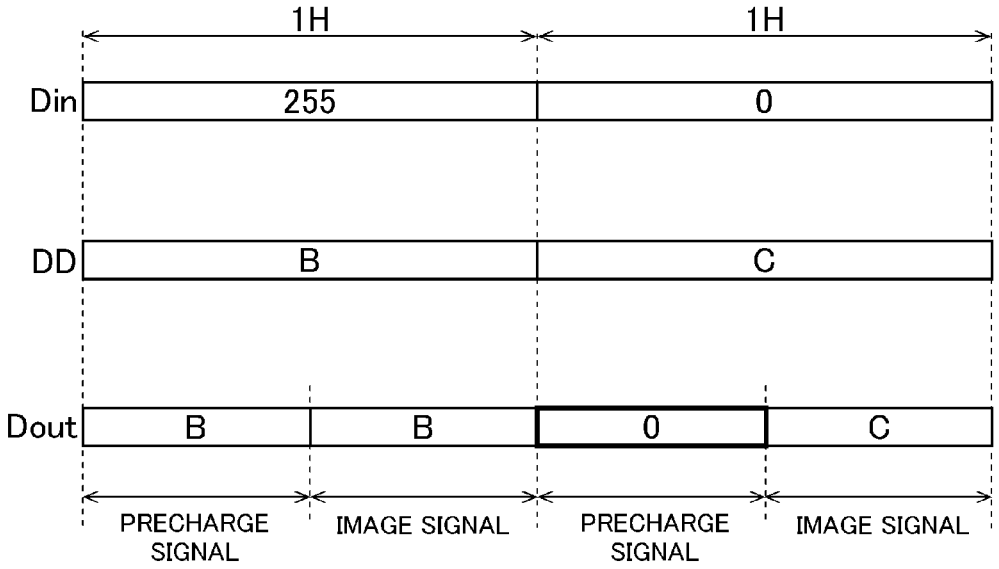
FIG. 11 is a chart showing changes with time of the display grayscale data, the gamma-converted data, and the output grayscale data in the case where the value of the display grayscale data changes from the largest to the smallest.
Figure 12:
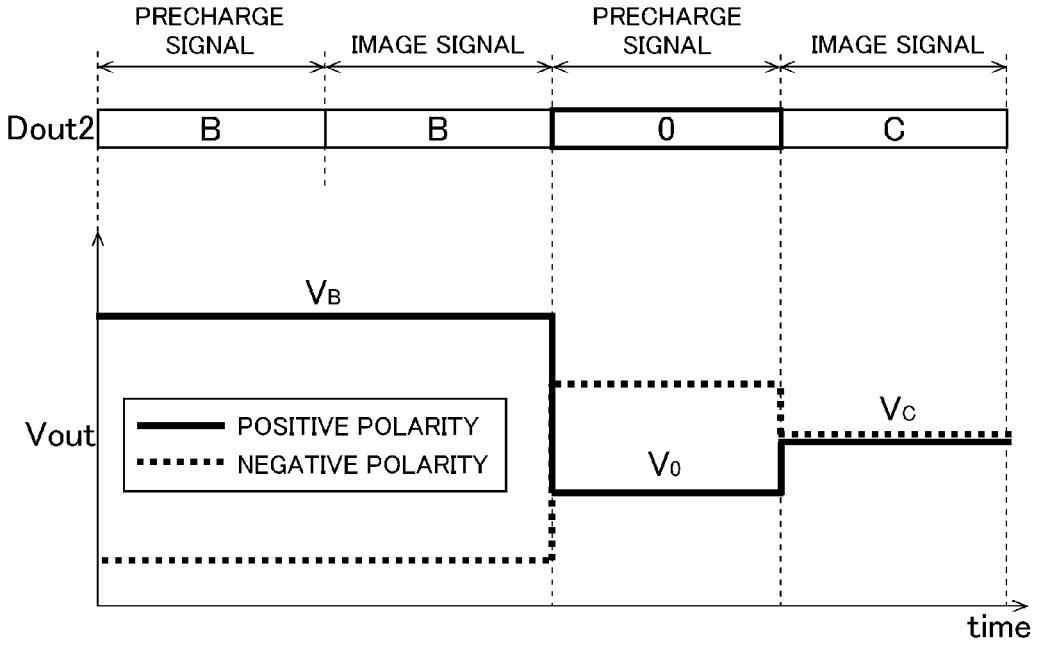
FIG. 12 is a chart showing changes with time of the output grayscale data and the output potential output from the data-line driving circuit in the case where the value of the display grayscale data changes from the largest to the smallest.

FIG. 11 is a chart showing changes with time of the display grayscale data Din(n,m), the gamma-converted data DD(n,m), and the output grayscale data Dout2(*n,m*) when the value of the display grayscale data Din(n,m) changes from the largest to the smallest. FIG. 12 is a chart showing changes with time of the output grayscale data Dout2(*n,m*) and the output potential Vout output from the data-line driving circuit XDV in the above-mentioned case. In the first horizontal period 1H, 255 is input as the value of the display grayscale data Din(n,m), and the output grayscale value of the gamma-converted data DD(n,m) generated thereby is B. If the value of the display grayscale data Din(n,m) in the preceding horizontal period 1H is 255, the output grayscale value of the precharge signal contained in the output grayscale data Dout2(*n,m*) output from the frame-rate control circuit FRC is B, and the output grayscale value of the image signal is B.

In the second horizontal period 1H, 0 is input as the display grayscale value of the display grayscale data Din(n,m), and the output grayscale value of the gamma-converted data DD(n,m) generated thereby is C. The output grayscale value of the precharge signal contained in the output grayscale data Dout2(*n,m*) output from the frame-rate control circuit FRC is the smallest value, that is 0, and the output grayscale value of the image signal is C. Even if the change in grayscale is large as described above, the data-line driving circuit XDV outputs the potential of the precharge signal lower than the potential of the positive-polarity image signal or the potential of the precharge signal higher than the negative-polarity image signal. As a result, the deterioration of image quality can be reduced. Further, the number of grayscales output from the data-line driving circuit XDV is not increased. Thus, an increase in circuit size can be suppressed.

Second Embodiment

A liquid crystal display device according to a second embodiment of the present invention differs from the liquid crystal display device according to the first embodiment in that the frame-rate control circuit FRC is not provided. Hereinafter, differences from the liquid crystal display device according to the first embodiment are mainly described.

Figure 13:
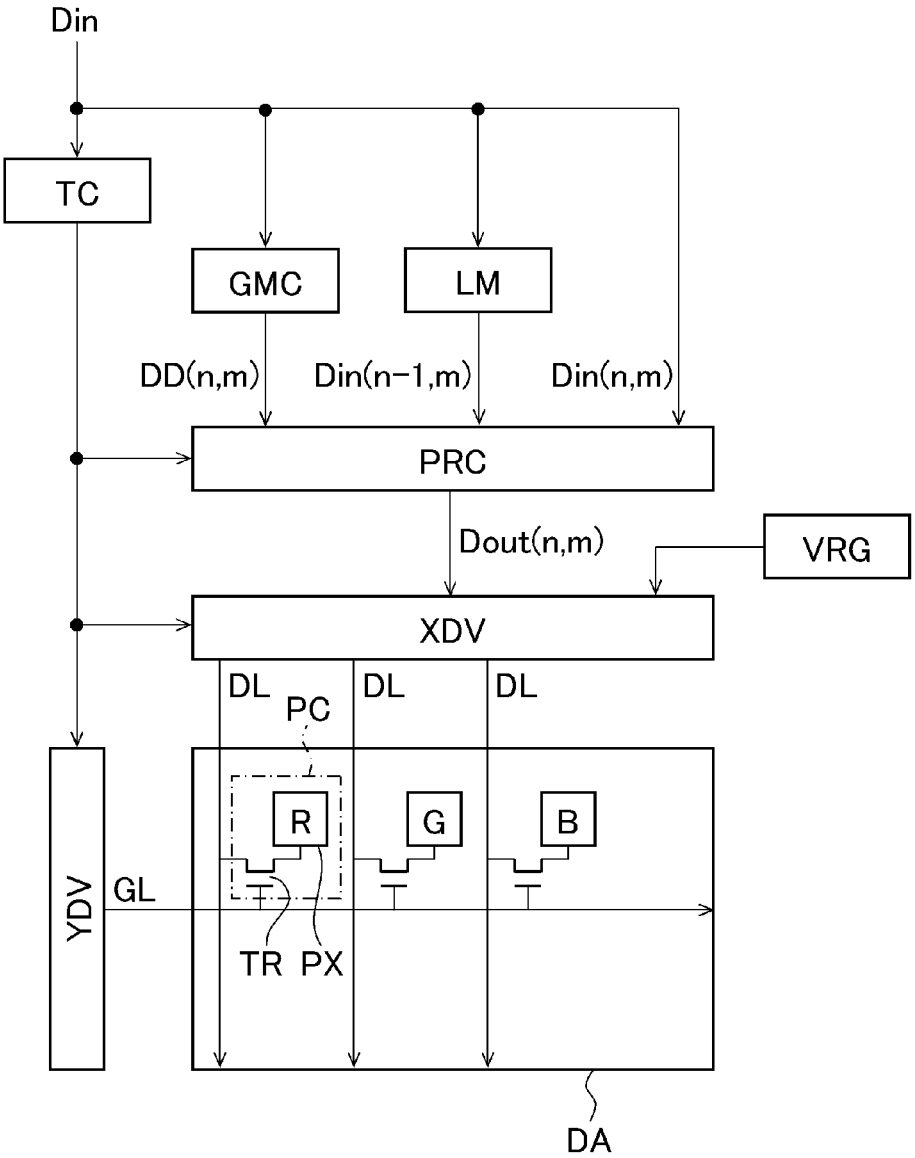
FIG. 13 is a diagram illustrating a configuration of a liquid crystal display device according to a second embodiment of the present invention.

FIG. 13 is a diagram illustrating an example of a configuration of the liquid crystal display device according to the second embodiment. The precharge circuit PRC corrects the display grayscale value based on the display grayscale data Din(n−1,m) in the preceding row and the display grayscale data Din(n,m) in the row as a target of output, and corrects the output grayscale value contained in the gamma-converted data DD(n,m), to thereby generate the output grayscale value indicating the potential of the precharge signal. The output grayscale value indicating the potential of the precharge signal and the gamma-converted data DD(n,m) are collectively output as output grayscale data Dout(n,m). Based on the output grayscale data Dout(n,m), the data-line driving circuit XDV feeds the potential of the precharge signal to the data line DL connected to the pixel circuits PC in the m-th column in the first half of the horizontal period 1H in which the pixel circuits PC in the n-th row are scanned by the scanning-line driving circuit YDV and feeds the potential of the image signal in the second half of the horizontal period 1H.

Figure 14:
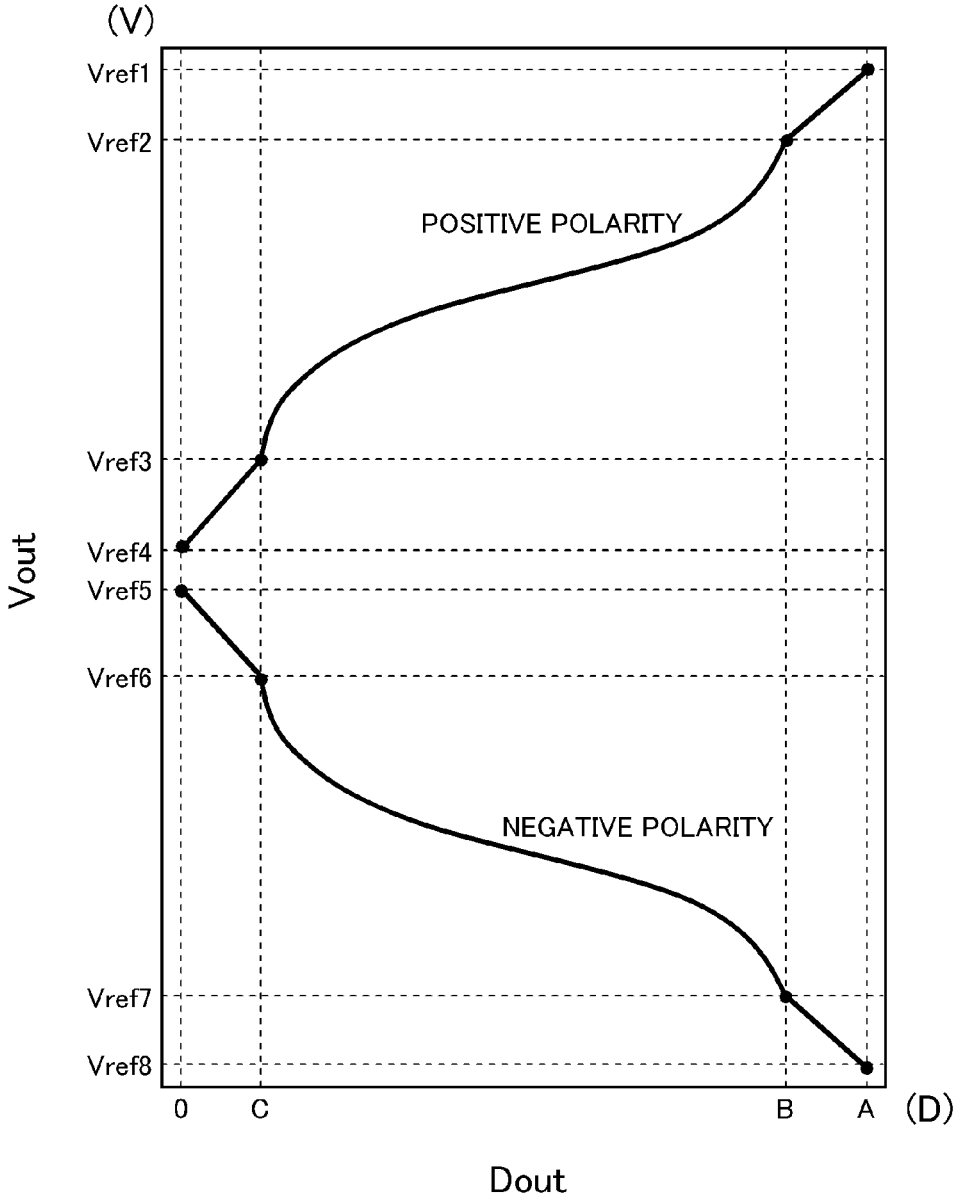
FIG. 14 is a graph showing an example of the relation between an output grayscale value and an output potential in a data-line driving circuit according to the second embodiment.

FIG. 14 is a graph showing an example of the relation between the output grayscale value and the output potential in the data-line driving circuit XDV according to the second embodiment. In FIG. 14, the output grayscale value corresponding to the lowest display grayscale is C, the output grayscale value corresponding to the highest display grayscale is B, and the largest output grayscale value is A. The value A is larger than 255 corresponding to the largest value of the display grayscale value. The data-line driving circuit XDV can output (A+1) types of output potentials. Between C and B, 256 output grayscale values can be set. The number of output grayscale values is the same as the number of levels which can be expressed by the display grayscale value.

The data-line driving circuit XDV can output, in addition to the output grayscale value corresponding to the display grayscale value in one-to-one correspondence, the output grayscale value for outputting the positive-polarity potential lower than the positive-polarity grayscale potential indicated by the smallest display grayscale value and the negative-polarity potential higher than the negative-polarity grayscale potential indicated by the smallest display grayscale value, and the output potential corresponding to the output grayscale value for outputting the positive-polarity potential higher than the positive-polarity grayscale potential indicated by the largest display grayscale value and the negative-polarity potential lower than the negative-polarity grayscale potential indicated by the largest display grayscale value.

In the example shown in FIG. 14, to the positive-polarity potential output section PG included in the data-line driving circuit XDV, the reference potential Vref1 corresponding to the largest output grayscale value, the reference potential Vref2 corresponding to the largest display grayscale value, the reference potential Vref3 corresponding to the smallest display grayscale value, and the reference potential Vref4 corresponding to the smallest output grayscale value are input. On the other hand, to the negative-polarity potential output section NG, the reference potential Vref5 corresponding to the smallest output grayscale value, the reference potential Vref6 corresponding to the smallest display grayscale value, the reference potential Vref7 corresponding to the largest display grayscale value, and the reference potential Vref8 corresponding to the largest output grayscale value are input. DV curves from the grayscales C to B are obtained by shifting the DV curves indicating the grayscale potential corresponding to the display grayscale value in the x-direction by C.

Figure 15:
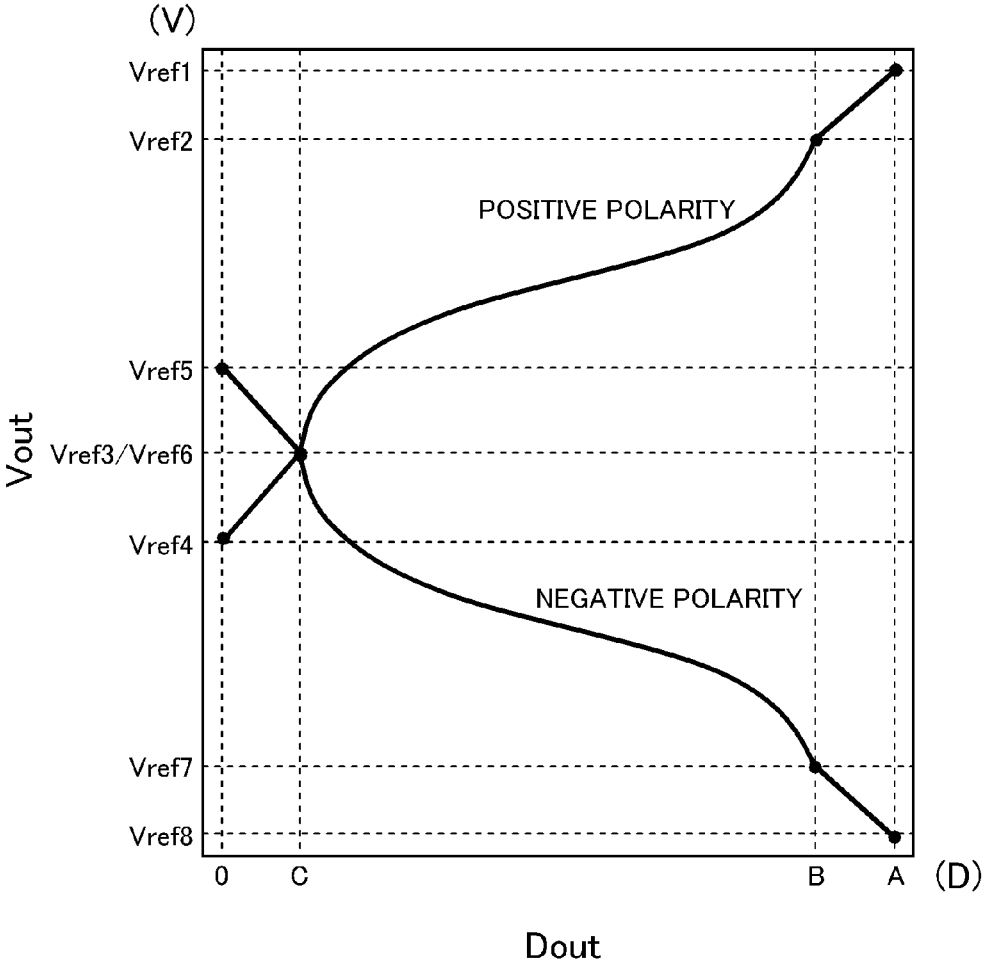
FIG. 15 is a graph showing another example of the relation between the output grayscale value and the output potential in the data-line driving circuit according to the second embodiment.

As in the first embodiment, the positive-polarity potential and the negative-polarity potential in accordance with the smallest display grayscale value may be the same. FIG. 15 is a graph showing another example of the relation between the output grayscale value and the output potential in the data-line driving circuit XDV according to the second embodiment. In FIG. 15, the reference potential Vref3 and the reference potential Vref6 are the same. The reference potential Vref4 is lower than the reference potential Vref5.

Figure 16:
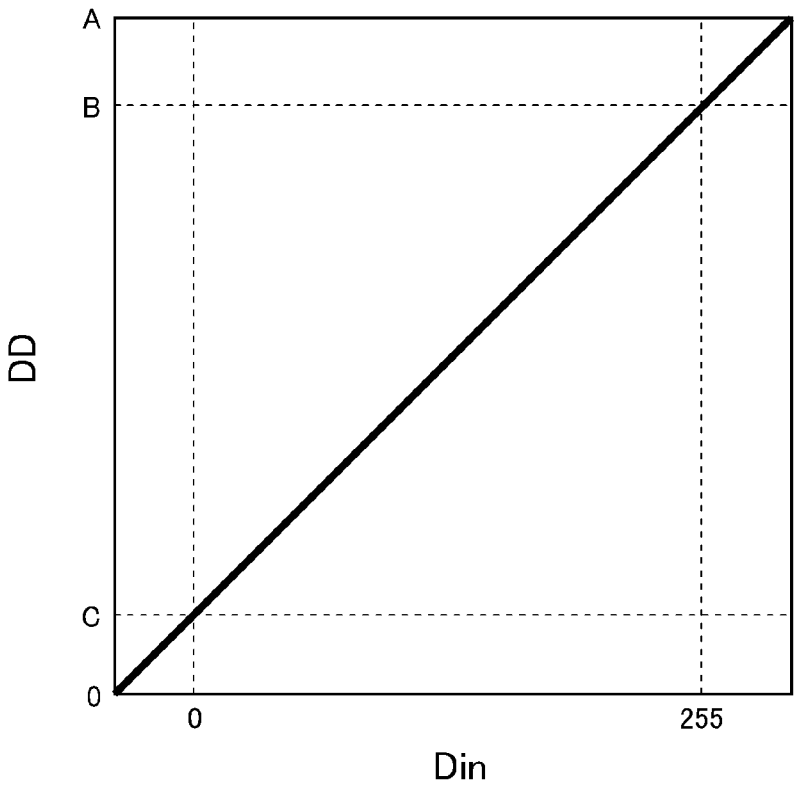
FIG. 16 is a graph showing an example of the relation between display grayscale data input to a gamma conversion circuit and gamma-converted data according to the second embodiment.

FIG. 16 is a graph showing an example of the relation between the display grayscale data Din(n,m) input to the gamma conversion circuit GMC and the gamma-converted data DD(n,m) according to the second embodiment. The output grayscale value of the gamma-converted data DD(n,m) is obtained by adding C to the display grayscale value of the display grayscale data Din(n,m). The number of the display grayscale values corresponding to the output grayscale value never becomes plural. In the case as shown in FIG. 16, when the display grayscale value changes from the largest to the smallest, the output potential in accordance with the output grayscale value of 0 can be output as the potential of the precharge signal. On the other hand, when the display grayscale value changes from the smallest to the largest, the output potential in accordance with the output grayscale value of A (>255) can be output as the potential of the precharge signal.

As described above, the deterioration of image quality due to the correction of the image signal and the insufficient capability of the data-line driving circuit XDV can be reduced even without providing the frame-rate control circuit FRC or causing a plurality of display grayscale values to correspond to one output grayscale value in the gamma conversion circuit GMC.

Figure 17:
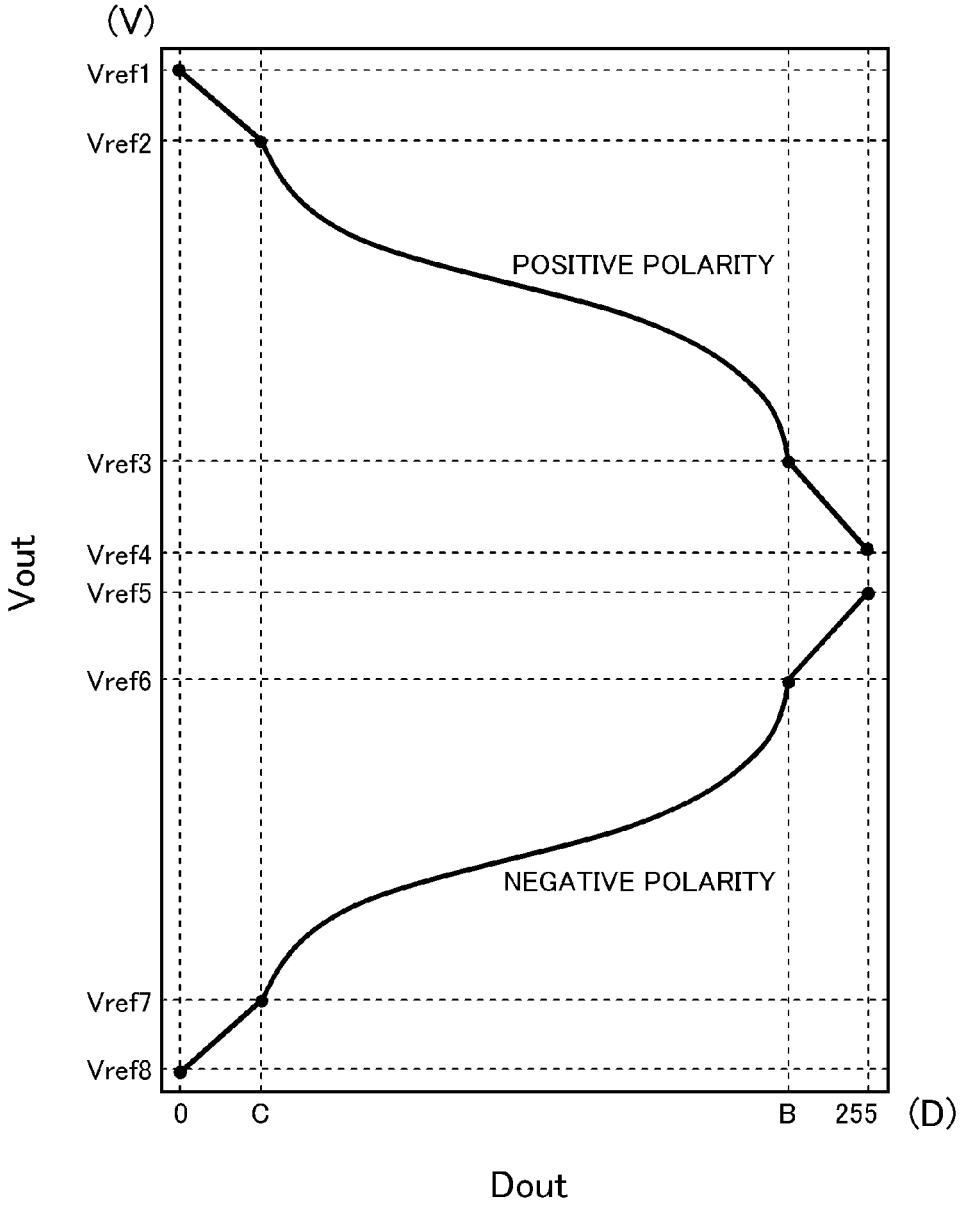
FIG. 17 is a graph showing another example of the relation between the output grayscale value and the output potential in the data-line driving circuit.

In the embodiments described above, the liquid crystal display device using normally-black liquid crystal has been described. However, the same effects can be obtained with a liquid crystal display device using normally-white liquid crystal. FIG. 17 is a graph showing another example of the relation between the output grayscale value and the output potential in the data-line driving circuit XDV. In the case of normally-white liquid crystal, the positive-polarity output potential monotonously decreases and the negative-polarity output potential monotonously increases as the output grayscale value increases. On the other hand, the following two characteristics are common to the normally-white liquid crystal and the normally-black liquid crystal. The first characteristic is that the data-line driving circuit XDV feeds a potential lower than the lowest positive-polarity grayscale potential indicated by the display grayscale value and feeds a potential higher than the highest positive-polarity grayscale potential. The second characteristic is that the data-line driving circuit XDV feeds a potential higher than the highest negative-polarity grayscale potential indicated by the display grayscale value and feeds a potential lower than the lowest negative-polarity grayscale potential. For example, as long as a switch of the data-line driving circuit XDV is configured so as to realize the DV curves as described above and the potential in accordance with the DV curves is fed, the same effects as those of the embodiments of the present invention can be obtained even when the normally-white liquid crystal is used.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a data line;

a plurality of pixel circuits, each including a transistor switch and a pixel electrode connected to the data line via the transistor switch;

an output grayscale value generating circuit for outputting an output grayscale value corresponding to one of a plurality of candidate values, the output grayscale value being obtained by correcting a display grayscale value indicating a grayscale potential having one of positive polarity and negative polarity to be applied to one end of the transistor switch included in any one of the plurality of pixel circuits; and a data-line driving circuit for selectively outputting, to the data line, an output potential having one of the positive polarity and the negative polarity corresponding to the output grayscale value from among a plurality of positive-polarity and negative-polarity output potentials corresponding to the plurality of candidate values, respectively, wherein the data-line driving circuit outputs the potential having one of the positive polarity and the negative polarity so that a lowest one of the plurality of positive-polarity output potentials respectively corresponding to the plurality of candidate values becomes lower than a lowest positive-polarity grayscale potential indicated by the display grayscale value and that a highest one of the plurality of negative-polarity output potentials respectively corresponding to the plurality of candidate values becomes higher than a highest negative-polarity grayscale potential indicated by the display grayscale value; and wherein when the output grayscale value generating circuit outputs a first output grayscale value and a second output grayscale value being higher than the first output grayscale value, the data-line driving circuit outputs:

the potential having one of the positive polarity corresponding to the first output grayscale value that is lower than the potential having one of the positive polarity corresponding to the second output grayscale value and the potential having one of the negative polarity corresponding to the first output grayscale value that is lower than the potential having one of the negative polarity corresponding to the second output grayscale value.

2. The liquid crystal display device according to claim 1, wherein the data-line driving circuit outputs the potential having one of the positive polarity and the negative polarity so that the lowest one of the plurality of positive-polarity output potentials respectively corresponding to the plurality of candidate values becomes lower than the highest one of the plurality of negative-polarity output potentials respectively corresponding to the plurality of candidate values.

3. The liquid crystal display device according to claim 1, wherein the data-line driving circuit outputs the potential having one of the positive polarity and the negative polarity so that a highest one of the plurality of positive-polarity output potentials respectively corresponding to the plurality of candidate values becomes higher than a highest positive-polarity grayscale potential indicated by the display grayscale value and that a lowest one of the plurality of negative-polarity output potentials respectively corresponding to the plurality of candidates becomes lower than a lowest negative-polarity grayscale potential indicated by the display grayscale value.

4. The liquid crystal display device according to claim 1, wherein:

the plurality of pixel circuits are arranged in a plurality of rows;

the output grayscale value generating circuit generates an output grayscale value of a precharge signal based on the display grayscale value for any one of the pixel circuits in a row and a display grayscale value for one of the pixel circuits in a preceding row, and generates an output grayscale value of an image signal based on the display grayscale value for the any one of the plurality of pixel circuits in the row; and the data-line driving circuit sequentially outputs an output potential corresponding to the output grayscale value of the precharge signal and an output potential corresponding to the output grayscale value of the image signal.

5. The liquid crystal display device according to claim 4, wherein:

the lowest positive-polarity grayscale potential indicated by the display grayscale value comprises a positive-polarity output potential of the image signal which is output by the data-line driving circuit in accordance with the display grayscale value indicating the lowest positive-polarity grayscale potential; and the highest negative-polarity grayscale potential indicated by the display grayscale value comprises a negative-polarity output potential of the image signal which is output by the data-line driving circuit in accordance with the display grayscale value indicating the highest negative-polarity grayscale potential.

6. The liquid crystal display device according to claim 4, wherein:

the output grayscale value generating circuit outputs the output grayscale value of the image signal so that the output grayscale value corresponding to the display grayscale value increases monotonously as the display grayscale value increases; and the output grayscale value generating circuit outputs an output grayscale value corresponding to the display grayscale value with one-to-one correspondence for the display grayscale value equal to or smaller than a predetermined display grayscale value indicating a brightness higher than a half of a maximum brightness, and outputs an output grayscale value corresponding to any one of the other display grayscale values for at least a part of the display grayscale values exceeding the predetermined display grayscale value.

7. The liquid crystal display device according to claim 6, wherein the output grayscale value generating circuit outputs the output grayscale value of the image signal, which periodically changes in accordance with at least a part of the display grayscale values larger than the predetermined display grayscale value.

8. The liquid crystal display device according to claim 6, wherein the data-line driving circuit has a larger rate of change in the output potential with respect to an increase in the output grayscale value within the range of the output grayscale value corresponding to the range of the display grayscale value from the predetermined display grayscale value to a largest display grayscale value, than a rate of change in the grayscale potential with respect to an increase in the display grayscale value within a range larger than the predetermined display grayscale value.

9. The liquid crystal display device according to claim 1, wherein a number of display grayscale values indicating the potential within a range of the grayscale potential having one of the positive polarity and the negative polarity, corresponding to a range of brightness from a maximum brightness displayed by the plurality of pixel circuits to a half of the maximum brightness, is larger than a number of the candidate values corresponding to the output potential within the range.

10. The liquid crystal display device according to claim 9, wherein the data-line driving circuit outputs an output grayscale value periodically changing in accordance with at least a part of the display grayscale values indicating the potential within the range of the grayscale potential.

11. The liquid crystal display device according to claim 1, wherein:

the data-line driving circuit comprises:

a positive-polarity potential output section for outputting a positive-polarity output potential; and a negative-polarity potential output section for outputting a negative-polarity output potential;

the positive-polarity potential output section outputs the positive-polarity output potential corresponding to the output grayscale value based on a plurality of first reference potentials;

the negative-polarity potential output section outputs the negative-polarity output potential corresponding to the output grayscale value based on a plurality of second reference potentials;

two of the plurality of first reference potentials comprise the lowest positive-polarity grayscale potential indicated by the display grayscale value and a potential lower than the lowest positive-polarity grayscale potential; and two of the plurality of second reference potentials comprise the highest negative-polarity grayscale potential indicated by the display grayscale value and a potential higher than the highest negative-polarity grayscale potential.

12. The liquid crystal display device according to claim 1, wherein the output grayscale value generating circuit includes a gamma conversion circuit configured to convert display grayscale data into gamma-converted data that includes an output grayscale value and adjustment information.

13. The liquid crystal display device according to claim 1, wherein the output grayscale value generating circuit includes a line memory configured to store display grayscale data for a first row and configured to output stored display grayscale data for a second row that is previous the first row.

14. The liquid crystal display device according to claim 1, wherein the output grayscale value generating circuit includes a precharge circuit configured to:

correct an output grayscale value contained in gamma-converted data based on display grayscale data for a target row and a row previous the target row, and output a grayscale value indicating a potential of a precharge signal.

15. The liquid crystal display device according to claim 1, wherein the output grayscale value generating circuit includes a frame-rate control circuit configured to receive grayscale values indicating a potential of a precharge signal and output the grayscale values as output grayscale data.

* * * * *